United States Patent [19]

Eirich

[11] Patent Number: 4,611,922

[45] Date of Patent: Sep. 16, 1986

[54] APPARATUS FOR TREATING MATERIALS WHICH ARE CAPABLE OF FLOW

[75] Inventor: Willi Eirich, Bahnhofstr. 19, 6969 Hardheim, Fed. Rep. of Germany

[73] Assignees: H. Eirich; P. Eirich; W. Eirich, all of Hardheim, Fed. Rep. of Germany

[21] Appl. No.: 668,729

[22] PCT Filed: Apr. 9, 1984

[86] PCT No.: PCT/DE84/00085

§ 371 Date: Sep. 19, 1984

§ 102(e) Date: Sep. 19, 1984

[87] PCT Pub. No.: WO84/04055

PCT Pub. Date: Oct. 25, 1984

[30] Foreign Application Priority Data

Apr. 9, 1983 [DE] Fed. Rep. of Germany ..... 3312869

[51] Int. Cl.[4] ..... B01F 9/00

[52] U.S. Cl. ..... 366/221; 366/224; 366/225; 366/231; 366/297; 366/311

[58] Field of Search ..... 366/53, 54, 56–59, 366/220, 221, 222, 223, 232, 292, 297–299, 224, 225, 230, 231, 309, 311

[56] References Cited

U.S. PATENT DOCUMENTS 3,746,267 7/1973 Myers et al. ..... 366/299 X
4,522,499 6/1985 Hudelmaier ..... 366/224 X

FOREIGN PATENT DOCUMENTS 2003201 11/1982 Fed. Rep. of Germany .
6612509 3/1968 Netherlands ..... 366/224

*Primary Examiner*—Timothy F. Simone
*Attorney, Agent, or Firm*—Austin R. Miller

[57] ABSTRACT

Described is an apparatus for treating materials which are capable of flow, comprising a container (1) which rotates about is central axis (5) which is inclined with respect to the vertical, with a wall and/or bottom scraper plate (2) which is arranged substantially stationarily with respect to the cylindrical inside wall of the container (1), a discharge opening (3) disposed in the bottom of the container (1) and a rotating tool (6) which engages into the material. To reduce the amount of power consumed, while giving good treatment effects, and to enhance the output of the machine, with respect to the available volume in the machine, it is proposed according to the invention, that the container (1) is driven at a sub-critical speed of rotation, the rotating tool (6) is arranged exclusively at the downstream side of the apex, that the space on the upstream side is free of fittings therein and that the scraper plate (2) is disposed in the vicinity of the apex of the container (1).

7 Claims, 9 Drawing Figures

APPARATUS FOR TREATING MATERIALS WHICH ARE CAPABLE OF FLOW

Figure 1:
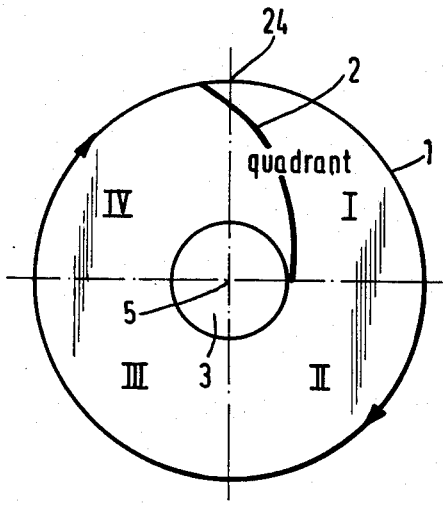

The invention relates to an apparatus for treating materials which are capable of flow, comprising a container which rotates about its central axis which is inclined with respect to the vertical, with a wall and/or bottom scraper plate which is arranged substantially stationarily with respect to the cylindrical inside wall of the container, a discharge opening disposed in the bottom of the container and a rotating tool which engages into the material.

German patent specification No. 2 003 201 already discloses a treatment apparatus of the kind set out above. In that apparatus however, the rotating container is driven at a super-critical speed of rotation. That arrangement uses such a speed of rotation that the centrifugal forces acting on the pieces of the material are greater than the weight of those pieces themselves. By virtue of the super-critical speed of rotation, defined in that manner, centrifugal forces are applied to the mix material in such a way that it adheres to the cylindrical inside wall surface of the container. For that reason, disposed at a stationary location in the known mixing container is a deflector member which cleans off the wall of the container and which removes the material to be treated, from the action of the centrifugal forces, in that it peels the material off the inside wall surface of the container and deflects it on the high-speed mixing tools. The known deflector member also has a lower portion which extends from the outer peripheral wall into the region of the discharge opening.

Such a treatment machine suffers from the disadvantage that, in order to produce a good mixing effect, the particles of material to be mixed must be displaced relative to each other as intensively and as frequently as possible. However, the use of the centrifugal force means that the material to be treated is pressed firmly against the inside wall surface of the mixing container, thus giving increased internal friction. That reduces the mobility and accordingly the mixability of the material.

The above-mentioned deflector member is also provided for turning over the material to be mixed. Because the deflector member has to remove the material clinging to the inside wall surface of the container, thereby overcoming centrifugal force, and deflect it towards the middle of the container, it also acts at the same time as a brake on the rotating container which on the one hand transports the treatment material, under pressure, against the deflector member. That means that the amount of power required for driving the container is comparatively large.

When the central axis of the container is in an inclined position, the high-speed mixing tool is disposed in quadrant III or IV thereof, that is to say, in the region of the rising flow of material. By virtue of that arrangement, the upward flow of material in the container is disturbed, with the result that substantially more material is to be found in the lower region of the container than in the upper region thereof. Due to that unequal filling of the container, the available mixing space in the upper part of the container is not utilised so that, in comparison with the available volume, the treatment machine has only a low filling capacity and thus has a lower treatment capability.

When dealing with materials to be mixed or materials to be treated, which have a low level of internal friction, such as for example powders or fluids, it is really difficult for the material to be treated to be accelerated by the movement of the container in such a way that the required flow of the material in the treatment container and the resulting mixing or treatment effect produced thereby is achieved, in spite of the high-speed mixing tool which has an additional opposing action.

In addition, problems arise by virtue of the uneven or irregular layer of treatment material in the container, when vapour or gases is or are introduced into the layer of material to be mixed, by means of tubular lances.

The problem of the present invention is therefore to improve an apparatus of the kind set sorth in the opening part of this specification, such that the amount of power consumed is reduced, while giving good treatment effects, and the output of the machine is enhanced, with respect to the available volume in the machine, by virtue of a higher degree of filling thereof.

According to the invention, that problem is solved in that the container is driven at a sub-critical speed of rotation, the rotating tool is arranged exclusively on the downstream side of the apex and the space on the upstream side is consequently free of fitments, and that the scraper plates are arranged in the vicinity of the apex of the container.

Driving a mixing container at a sub-critical speed of rotation is obviously already known per se. However, the design of such mixers differs considerably from the apparatus according to the invention in regard to the configuration of the machine, the arrangement of the central axis of the container, in space, the arrangement of installed tools therein, and the processing action. In the case of the known treatment and mixing machine, the super-critical speed of rotation of the container for the material to be mixed is considered to be an unavoidable requirement in order to achieve good treatment results. However, the clever combination of the novel features of the invention as set forth above, permit enhanced efficiency to be achieved, using a lower level of power. By virtue of the arrangement of the rotating tools on the downstream side, that is to say, in quadrants I and II of the rotating container, the material to be mixed can rise without impediment towards the apex on the upstream side, and can be uniformly distributed in the container. The uniform distribution of material in turn advantageously provides a substantially higher degree of filling of the container, and can thereby improve the output of the machine.

If the rotating tools are positioned in quadrant II, they are always uniformly acted upon with material to be mixed, regardless of whether the material experiences a strong conveying action by virtue of the plate member, on the basis of increased internal friction (acted upon from above) or whether the material to be treated, by virtue of a lower level of internal friction, in the initial phase, is less subjected to a conveying action by the container.

The respective rotating tool which is preferably disposed in quadrant II is supplied with material to be treated in a highly effective manner by virtue of the arrangement according to the invention, in conjunction with the sub-critical speed of rotation of the container, more specifically because the kinetic energy of the material to be treated, which impinges on the rotating tool, is not only produced by the rotational energy of the container which accelerates the material to be treated in the rising region and which causes it to impinge with corresponding rotational energy, but in addition there is also the force of gravity or the weight of the material to be treated itself.

In contrast to the known treatment machine, in the case of the features according to the invention, a positive effect is advantageously achieved if the material to be treated does not have to be peeled off by the scraper plates, overcoming the centrifugal force which presses the material against the inside wall surface of the container. By virtue of the material flowing away due to the force of gravity acting thereon, the scraper plate which acts like a deflector member in principle only then has to perform the function of cleaning the container wall and bottom and preferably conducting the material to the discharge opening during the emptying phase. Whereas, in the case of the known treatment machine, the material to be processed was subjected to a sharp change in direction and had to be urged, under a force applied thereto, into the rotating tool disposed in quadrant III or quadrant IV, in accordance with the invention the change in direction no longer has to be comparatively sharp. In other words, the deflection effect is no longer used for treating the material in the container but primarily only for emptying purposes. That means that the resistance which the material to be treated experiences in flowing past the scraper plate is clearly lower. That means that substantially less energy is consumed and less wear is produced.

The apparatus according to the invention is particularly suitable for use in the treatment of bulk or loose materials as are processed for example in the building materials industry, the ceramic industry and the chemical industry. Those fields of use frequently involve materials to be mixed, which substantially change in flow characteristics during the mixing operation. For example it is conventional practice in the ceramic industry to knead a plastic material from fine, air-sifted clay powder and water. At the beginning of the mixing operation, the two components of the mixture which are introduced into the apparatus are very fluid while at the end of the mixing period they may represent a sticky, plastic mass.

In the past, it was frequently conventional practice to use different mixing and threatment apparatuses for such purposes, in particular for pre-mixing and post-mixing.

In contrast, the features according to the present invention make it possible for all consistencies of material to be mixed to be processed without difficulty.

In another advantageous embodiment of the invention, at least a portion, preferably the lower section, of the scraper plate is pivotal and can be locked about an axis which is parallel to the central axis of the container. That arrangement provides a so-to-speak pivotally disposed deflector member which for example is disposed in the direction of movement of the rotating container, during the mixing operation, and is only pivoted into position for the emptying process. That has the advantage that the flow of material to be mixed is not braked by the deflector member during the mixing period.

Instead of providing a fixed position for the scraper plate at the beginning of the operation and another fixed position for the emptying phase, and locking the plate in place, the pivotal portion of the scraper plate may also be controlledly adjusted throughout the entire period of treatment. In that way for example material to be mixed can be deflected on the mixing tools, for example the rotating tools, to a greater or lesser degree, as required. In that way the flow of material to be mixed can always be automatically directed on to the mixing tool in such a strength that the mixing tool always operates under a preselected motor load condition.

It is also advantageous in accordance with the present invention for two rotating tools to be arranged in succession in the direction of flow of the material and to be displaced relative to each other, in quadrants I and II, in such a way that the downstream tool acts on the free space of material of the upstream tool. Whether now the second rotating tool is or is not displaced relative to the first rotating tool in the direction of flow and/or also transversely with respect thereto, at any event the arrangement of two rotating tools which are preferably each somewhat smaller than when the apparatus uses only a single rotating tool makes it possible for the entire surface of the bottom of the container to be swept, without expensive machinery features having to be employed in order to act on all the material to be treated.

If two rotating tools are disposed adjustably, then the material to be treated can be subjected to severe treatment between the tools, as required, or one tool can cause the material to be treated to be transported into the free space provided by the other tool.

In accordance with the invention, it is also desirable if, in a particularly preferred embodiment, the rotating tool has blades which are shorter in the radial direction, in the lower region, adjacent the bottom of the container, than in the upper region. In regard to the definition of the term 'lower', it is assumed that the person viewing the machine is looking downwardly into the container, with the cover removed, and assumes that the bottom with the discharge opening is at the bottom and the feed opening is 'at the top'. The discharge opening is intended to cooperate with the other tools installed in the container in order to provide for rapid emptying so that the output of the apparatus according to the invention can be improved. In such a case, it is desirable if the lower blades of the rotating tool do not sweep entirely or for a major part over the discharge opening because in that way the treated material is prevented from being discharged from the container, in the emptying phase. The above-indicated features of the blades which are shorter in the radial direction at the bottom of the container promote that aim.

It has been found that, by virtue of the features according to the invention, in particular the use of the sub-critical speed of rotation, in conjunction with the higher degree of filling, it is possible to use more effective rotating tools than in the known apparatuses of the kind set forth in the opening part of this specification. The rotating tools of the known apparatus were in the form of a single ring of blades which project in the axial direction, at the end of a shaft, with the ring of blades being disposed at the end of the shaft in the region of the bottom of the container, possibly also at a certain distance from the bottom of the container. At any event, it was only at the cost of considerable design expenditure and energy that it was possible to use tools having a plurality of rings of blades, because the power consumption of such a rotating tool would have been incomparably high; even if there was not the fear of damage to the rotating tools.

The advantageous combination of a sub-critical speed of rotation, the setting of the scraper plate and the configuration of a rotating tool with its advantageous positioning in the downstream region of the container however unexpectedly permit the rotating tools to be of a configuration having more than one ring of blades, preferably 3 to 6. Accordingly, two to five rings of blades are to be considered, arranged one above the other, in the axial direction of the shaft of the rotating tool, wherein the blades preferably project in a radial direction, and are possibly set at an inclined angle, so that the plane thereof is set at an angle to a plane which is normal to the axis of the shaft. In accordance with the invention, the container has a filling capacity of considerable height so that all rings of blades can operate in the material filling the container, and are thereby highly effective in operation. For example, a good vertical mixing effect is also achieved, that is to say, a component of movement of the material to be treated, in the direction of the axis of the shaft of the rotating tool.

However, due to the reduction in the length of the blades in the radial direction towards the bottom of the container, not only can the discharge opening be kept free so that the material to be treated can be emptied from the container more rapidly, but enhanced distribution of energy by the rotating tool to the material to be treated is also achieved. More particularly, by virtue of the weight of the material, there is a greater pressure on the material in the lower region than in the upper region. The fact that the blades are shorter in the lower region than in the upper region has so-to-speak an inversely proportional effect so that substantially the same power consumption occurs both in the lower part and in the upper part of the container, thus giving equal wear and an equal service life for the tools.

The fact that the blades are shorter in the lower region of the container also advantageously makes it possible for the deflecting part of the scraper plate, which is disposed in the vicinity of the bottom of the container, to have a greater range of sweep. Preferably, the deflector part of the scraper plate can be longer for, due to the reduction in the radial range of action of the rotating tool, in the vicinity of the bottom of the container, the deflector part of the scraper plate has more space. Because of that, an emptying operation can be initiated and carried out in an advantageous manner even when the deflector portion of the scraper plate extends to the rearward edge of the discharge opening (as viewed in the direction of rotation of the container) because all the material to be treated is engaged thereby while nonetheless a sharp change in the direction of the flow of material is avoided (that position of the deflector member is shown in quadrant I in FIG. 1). If the flow of material towards the emptying opening is improved, then there is less of a build-up of material in a container emptying situation, emptying is more rapid, and consequently there is the advantage that, with the same mixer operating time (or batch time), the emptying time available is shorter and the processing time available is greater, so that the output of the apparatus is improved, as required.

Figure 2:
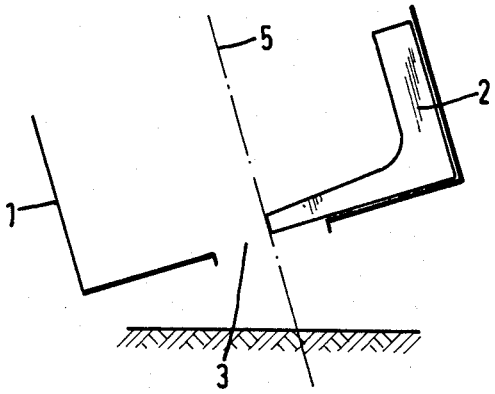
Figure 3:
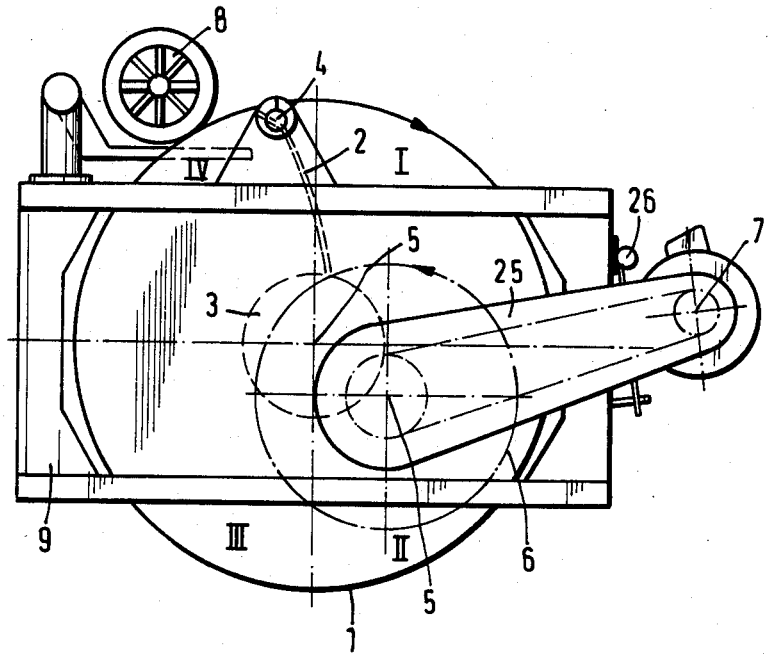
Figure 4:
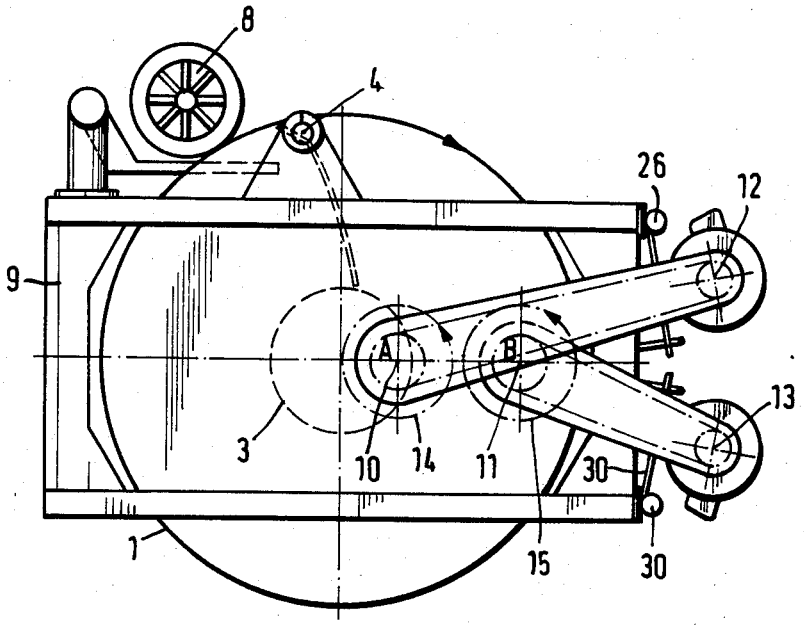
Figure 5:
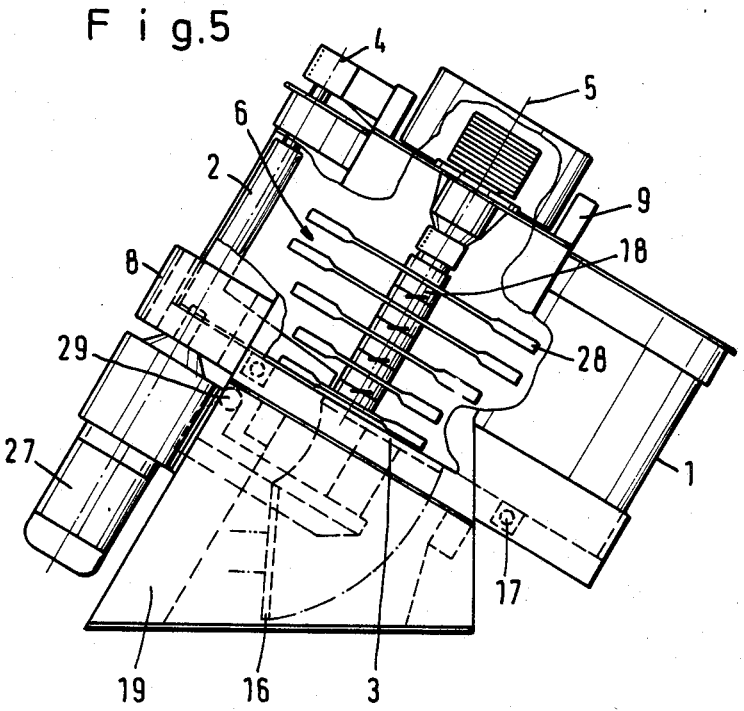
Figure 6:
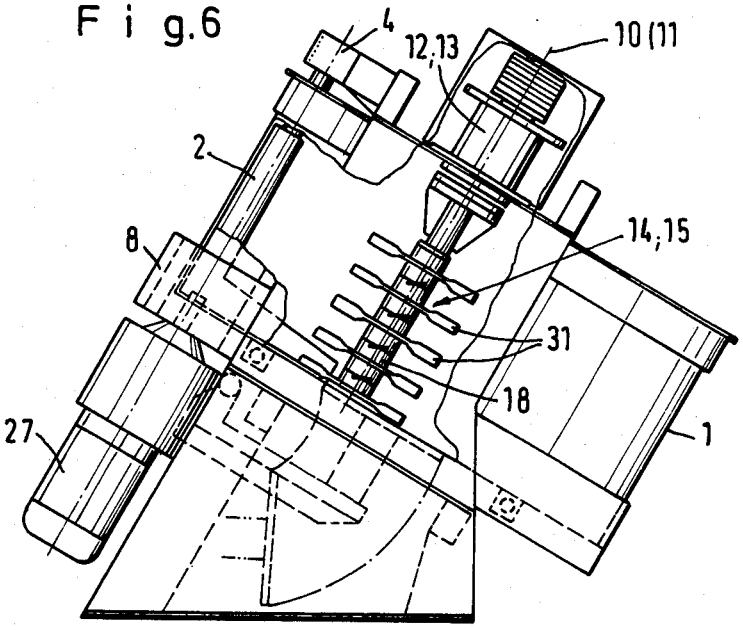
Figure 7:
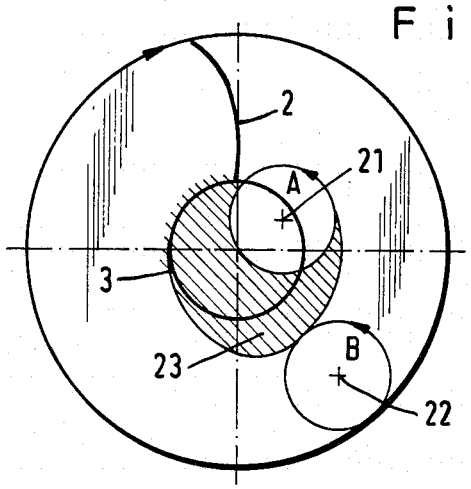
Figure 8:
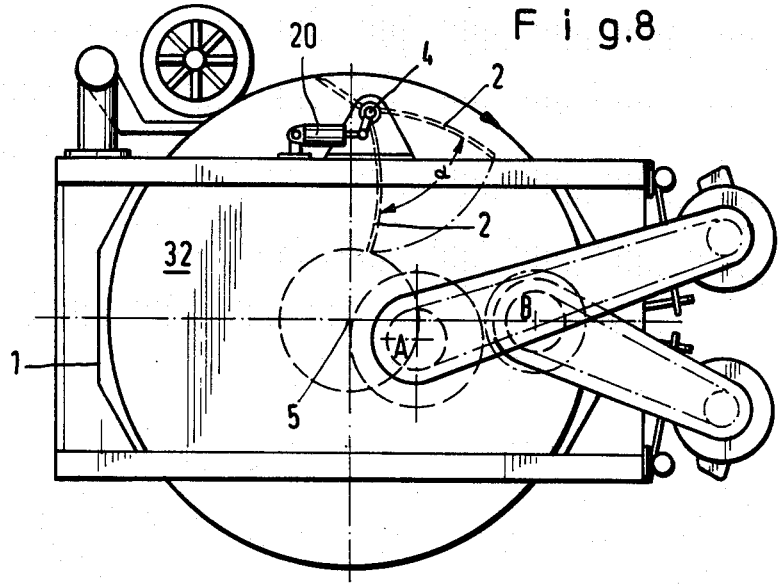
Figure 9:
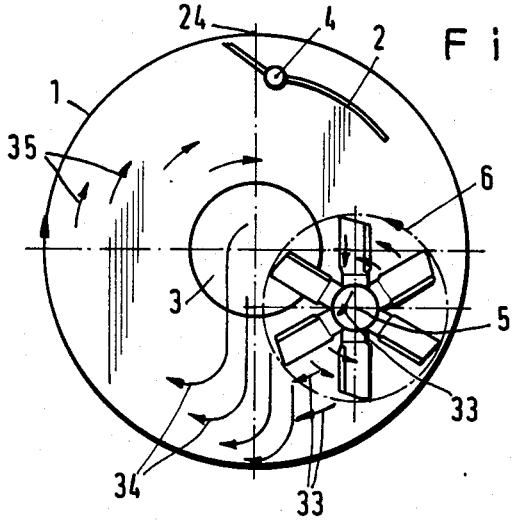

Other advantages, features and possible uses of the present invention are set forth in the following description, with reference to the accompanying drawings in which:

FIG. 1 is a diagrammatic plan view of a treatment container shown in the form of a circle, for the purposes of defining the quadrants and the time indicator positions, wherein the term treatment, in relation to the illustrated embodiments, is to be interpreted as meaning mixing, FIG. 2 is a side view of FIG. 1, also in diagrammatic form, for the purposes of defining the time indicator positions, FIG. 3 shows a plan view of a first embodiment of a mixing machine having a rotating tool and stationary scraper plate, FIG. 4 shows a plan view similar to FIG. 3 but of a second embodiment having two rotating tools, the axes of rotation of which are essentially disposed in juxtaposition on the dividing line between quadrants I and II, FIG. 5 shows a partly broken-away view of the apparatus of FIG. 3, from the left-hand side thereof, FIG. 6 shows a partly broken away view of the apparatus of FIG. 4, from the left-hand side, FIG. 7 shows a similar diagrammatic view to that shown in FIG. 1, wherein two rotating tools are arranged at displaced positions and in succession in the direction of flow of the material, FIG. 8 shows a plan view of another embodiment of a mixing machine similar to that shown in FIG. 4, with an adjustable scraper plate, and FIG. 9 shows another diagrammatic view similar to that shown in FIGS. 1 and 7, but with a scraper plate at a different position, showing the flow of material in a mixing machine of the first embodiment as shown in FIGS. 3 and 5.

In order to improve the describability of the apparatuses shown in FIGS. 3 to 8 and in order to define the individual positions of components of the machine, reference will first be made to FIGS. 1 and 2.

In FIG. 1, the person viewing the apparatus is looking in the direction of the central axis 5 of the treatment container 1 which is accordingly represented as a circle about the centre point 5. When the container 1 rotates in the direction indicated by the circular arrow, wherein the central axis 5 is disposed relative to the vertical at an angle of from 20° to 80° and preferably from 45° to 75°, then the apex which represents the upper part at the right in FIG. 2 occurs at 24, in the twelve o'oclock position. The scraper or stripping plate 2 is also disposed in that region, and in substance comprises two plate portions, as shown in FIG. 2. One plate portion is just as narrow as the other but extends on the inside of the cylindrical wall of the container, parallel to the central axis 5; while the other plate portion extends normal thereto, into the region of the discharge opening 3. In the diagrammatic view shown in FIGS. 1, 2 and 7, the scraper plate 2 is shown as being a one-piece component. However, it may also comprise two plate portions which are secured together or which are even pivotal relative to each other, as can be seen for example from FIGS. 8 and 9.

In FIG. 1 quadrants I and II are disposed on the right of the line extending through 6 o'clock and 12 o'clock, being on the downstream side of the apex 24; consequently, quadrants III and IV are disposed on the opposite side of the line extending from 6 o'clock to 12 o'clock, with the respective boundaries between quadrants I and II and between quadrants III and IV being the line going through 3 o'clock and 9 o'clock.

With that conceptual model, the views shown in FIGS. 3 and 4 will be more readily appreciated. FIG. 3 shows a first embodiment of a mixing machine in which the rotating container 1 is mounted in the machine frame 9 by means of bearings 17 (see FIG. 5), and is driven by the friction wheel 8. Arranged on the mounting arm 4, as the fixing point for the deflector member, is the scraper plate 2. The central axis 5' of the large rotating tool 6, which axis extends parallel to the central axis 5 of the container 1, lies in quadrant II. The circular line 6 shown as a dash-dotted line, with the arrow, shows the direction of rotation of the rotating tool 6, which is opposite to the direction of rotation of the container at the location closest to the inside wall of the container 1. The rotating tool 6 is mounted by means of an arm 25 which, like the drive motor 7 of the rotating tool 6, is supported on the machine stand 26.

The apparatus in FIG. 5 is shown in side view. A lower machine space or chamber 19 represents the general mounting arrangement for the container 1 and the drive arrangements thereof. The motor 27 drives the friction wheel 8 and the scraper plate 2 is mounted adjustable by means of the mounting arm 4.

The rotating tool 6 comprises a composite shaft 18, along which respective spaced mixing and crushing blades 28 are disposed one above the other so that virtually the entire filling volume of the container 1 can be swept by the blades. In the embodiment shown in FIG. 5, the blades disposed at the lower free end of the shaft 18 are shorter in the radial direction than the middle blades and the latter are in turn radially shorter than the upper blades.

The discharge opening 3 is closed by a closure cover member 16 which is shown in the closed condition in the broken-line position and in the open condition in the dash-dotted line position. The point of rotation for opening and closing the cover member 16 is indicated by reference numeral 29.

The embodiment shown in FIGS. 4 and 6 is very similar to that shown in FIGS. 3 and 5, but instead of a large rotating tool 6, this embodiment has two small tools 14 and 15, the central axes 10 and 11 of which are disposed one beside the other, on the dividing line between quadrants I and II, that is to say, in the direction of flow of material in the container 1. Instead of a support frame structure, this embodiment has two support frame structures 26 and 30 for mounting the two rotating tools 14 and 15; correspondingly, there are also two drive motors 12 and 13.

In the embodiment shown in FIG. 6, the smaller rotating tool 14 or 15 also comprises a number of radial blades 31 which are arranged at a spacing along the shaft 18' and the radial dimension of which is smaller in relation to that of the blades 28 of FIG. 5, being equal to each other.

FIG. 4 is intended primarily to illustrate a different arrangement in respect of the two rotating tools with their central axes 21 and 22. One rotating tool A is disposed at an upstream position and the other tool B is disposed at a downstream position, in the direction of flow of the material to be treated. The central axis 21 of the first tool A is disposed in quadrant I while the central axis 22 of the second tool B is disposed in quadrant II. Shown in the region of the discharge opening 3 is a free space 23, illustrated in broken line, into which the downstream and also displaced second tool B operates.

The diagrammatically illustrated deflector member 2 is set transversely in the direction of the flow of material, as is required for example in the emptying phase.

FIG. 8 shows an apparatus similar to that shown in FIG. 4, but in which the two tools A and B are set somewhat differently, with respect to the direction of flow of the material. FIG. 8 clearly shows the hydraulic cylinder 20, which acts as an actuating or drive means for the deflector member, for moving the scraper plates 2. The mounting arm 4 is so-to-speak a pivot between a stationary part of the scraper plate 2 which extends substantially parallel to the central axis 5 of the container, that is to say, the projecting part of the L-shaped deflector member. The other part of the scraper plate 2, which is shown as being of a bent or curved configuration in the embodment illustrated in FIG. 8, is small in the direction of the central axis 5, and extends as the other limb of the L-shape of the scraper plate 2 along the bottom of the container 1, as indicated by reference numeral 32. The curved scraper plate can be pivoted through the angle $\alpha$ from the position shown in dash-dotted lines into the position shown in broken lines and back. Depending on the mode of actuation of the hydraulic cylinder unit 20, adjustment may be continuous in the course of operation, or the arrangement may be preset in a fixed position.

In operation for example the flow conditions shown in FIG. 9 occur. The material to be mixed is conveyed without further disturbance by the lower arcuate portion of the scraper plate 2 from the apex 24 in the clockwise direction into quadrant I. A part of the material to be treated is deflected while another part, in particular in the upper layers of material, flows over the deflector member 2 towards the wall of the plate member. The flow of material which flows away in the clockwise direction in quadrant I is cut transversely by the rotating tool 6. A part of the material to be mixed is not engaged by the tool 6 and continues its movement in the direction of rotation of the container 1, as indicated for example by the two arrows 33. Those flows of material continue their movement in the direction of rotation of the container into quadrant II and through that quadrant to quadrant III. The various divided flows of material to be mixed then meet again in the boundary region between quadrants II and III, thus giving a flow of material as indicated by the curved arrow 34.

As quadrants III and IV are free of fitments installed therein, the material can flow upwardly in the direction indicated by the arrow 35 until the cycle begins again.

By virtue of the different positioning of the arcuate portion of the scraper plate 2 as shown in FIG. 8, more or less material to be mixed can be fed to the two rotating tools employed in the machine shown in FIG. 8, as indicated at 14 or A and 15 or B, or to the discharge opening 3.

I claim:

1. Apparatus for treating flowable materials comprising a substantially cylindrically shaped container divided into two uppermost quadrants I and IV and two lowermost quadrants II and III, said quadrants being arranged in succession about a central axis, said container having a bottom and a wall extending upwardly therefrom, said container being mounted for rotation about said central axis and said axis being inclined with respect to the vertical, thereby forming downstream flow portions and upstream flow portions of said rotating container, said downstream flow beginning at an apex of said container formed by said incline, said container also having a wall and/or bottom scraper plate which is arranged substantially stationarily with respect to the wall of the container, a discharge opening disposed in the bottom of the container and a rotating tool which engages into the material, characterized in that the container is driven at a sub-centrifugal speed of rotation, the rotating tool being arranged exclusively in the downstream portion in quadrant I and/or II, the space in the upstream portion in quadrants III and IV including no further material mixing apparatus and said scraper plate being disposed in the vicinity of the apex of the container.

2. Apparatus according to claim 1 characterised in that at least a portion of the scraper plate is pivotal about and can be locked about an axis which is parallel to the central axis of the container.

3. Apparatus according to claim 1 characterised in that two rotating tools are arranged in succession in the direction of the flow of material and in displaced positions in quadrants I and II in such a way that the downstream tool acts on the free space of material of the upstream tool.

4. Apparatus according to claim 1 characterised in that in the lower region adjacent the bottom of the container the rotating tool has blades which are shorter in the radial direction than in the upper region.

5. Apparatus according to claim 2 characterised in that two rotating tools are arranged in succession in the direction of the flow of material and in displaced positions in quadrants I and II in such a way that the downstream tool acts on the free space of material of the upstream tool.

6. Apparatus according to claim 2 characterised in that in the lower region adjacent the bottom of the container the rotating tool has blades which are shorter in the radial direction than in the upper region.

7. Apparatus according to claim 3 characterised in that in the lower region adjacent the bottom of the container the rotating tool has blades which are shorter in the radial direction than in the upper region.

* * * * *